US008111223B2

(12) United States Patent
Yeo et al.

(10) Patent No.: US 8,111,223 B2
(45) Date of Patent: Feb. 7, 2012

(54) METHOD OF LOCAL DIMMING, BACKLIGHT ASSEMBLY FOR PERFORMING THE METHOD AND DISPLAY APPARATUS HAVING THE BACKLIGHT ASSEMBLY

(75) Inventors: Dong-Min Yeo, Daegu (KR); Gi-Cherl Kim, Yongin-si (KR); Byung-Choon Yang, Seoul (KR); Yong-Hoon Kwon, Asan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 481 days.

(21) Appl. No.: 12/335,707

(22) Filed: Dec. 16, 2008

(65) Prior Publication Data

US 2009/0189543 A1 Jul. 30, 2009

(51) Int. Cl.
*G09G 3/32* (2006.01)

(52) U.S. Cl. ..... 345/82; 345/102; 345/690; 315/97; 315/360

(58) Field of Classification Search ..... 345/60, 345/76, 82–88, 102, 204, 690; 315/169.3, 315/169.4, 291, 297, 307, 360
See application file for complete search history.

(56) References Cited

U.S. PATENT DOCUMENTS

| | | | | |
|---|---|---|---|---|
| 7,394,448 | B2 * | 7/2008 | Park et al. | 345/102 |
| 7,859,554 | B2 * | 12/2010 | Young | 345/690 |
| 2007/0216636 | A1 * | 9/2007 | Lo | 345/102 |
| 2007/0279372 | A1 * | 12/2007 | Elliott et al. | 345/102 |
| 2008/0062105 | A1 * | 3/2008 | Han et al. | 345/90 |
| 2008/0150853 | A1 * | 6/2008 | Peng et al. | 345/87 |

* cited by examiner

*Primary Examiner* — Tung X Le
(74) *Attorney, Agent, or Firm* — F. Chau & Associates, LLC

(57) ABSTRACT

In order to perform local dimming, a driving dimming duty cycle is generated using a target gamma curve (TGV), wherein the driving dimming duty cycle corresponds to a representative grayscale value (RGV) of each of a plurality of dimming unit areas. Each of a plurality of light unit blocks of a light source is driven based on the driving dimming duty cycle, wherein the light unit blocks correspond to the dimming unit areas, respectively. Therefore, a display apparatus may display an image having a higher contrast ratio than normal.

17 Claims, 8 Drawing Sheets

METHOD OF LOCAL DIMMING, BACKLIGHT ASSEMBLY FOR PERFORMING THE METHOD AND DISPLAY APPARATUS HAVING THE BACKLIGHT ASSEMBLY

CROSS-REFERENCE TO RELATED APPLICATION

This application claims priority under 35 U.S.C. §119 to Korean Patent Application No. 2008-7877, filed on Jan. 25, 2008 in the Korean Intellectual Property Office (KIPO), the contents of which are herein incorporated by reference in their entirety.

BACKGROUND OF THE INVENTION

1. Technical Field

The present disclosure relates to a method of local dimming, a backlight assembly for performing the method, and a display apparatus having the backlight assembly. More specifically, the present disclosure relates to a method of local dimming that is capable of individually driving light-emitting unit blocks, a backlight assembly for performing the method, and a display apparatus having the backlight assembly.

2. Discussion of Related Art

Generally, a liquid crystal display (LCD) apparatus includes an LCD panel displaying an image using the light transmissivity of liquid crystals and a backlight assembly arranged under the LCD panel and supplying light to the LCD panel.

The LCD panel includes an array substrate having pixel electrodes and thin-film transistors (TFTs) electrically connected to the pixel electrodes, a color filter substrate having a common electrode and color filters, and a liquid crystal layer disposed between the array substrate and the color filter substrate.

The arrangement of the crystals of the liquid crystal layer is changed by an electric field formed between the pixel electrodes and the common electrode, so that the light transmissivity of the liquid crystal layer is changed. When the light transmissivity is increased to a maximum level, the LCD panel may display a white image having the highest luminance level. Whereas, when the light transmissivity is decreased to a minimum level, the LCD panel may display a black image having the lowest luminance level.

Because the liquid crystal layer is generally difficult to perfectly arrange in a definite direction, however, the LCD panel may generate light leakage at low grayscale values. That is, it may be difficult for the LCD panel to display a perfectly black image, so that the LCD panel may display an image having a low contrast ratio.

In order to prevent a contrast ratio of the image from decreasing, a local dimming method capable of individually generating light according to a position on the panel was recently developed. The local dimming method is a driving method of light-emitting unit blocks that supplies dimmed light to a pixel displaying a black image of a low grayscale level for increasing the contrast ratio.

SUMMARY OF THE INVENTION

An exemplary embodiment of the present invention provides a local dimming method that includes a step of converting a representative grayscale value (RGV) corresponding to each of a number of light-emitting unit blocks into a representative luminance value. That is, each of the light-emitting unit blocks may generate dimmed light using the representative luminance value convened from the RGV.

The RGV including a red RGV, a green RGV and a blue RGV is generally converted into the representative luminance value through an sRGB-to-YCbCr transformation matrix. For example, the red RGV (R), the green RGV (G) and the blue RGV (B) may be converted into the representative luminance value (Y) through the following known formula.

$$Y=0.2126R+0.7152G+0.0722B$$

The representative luminance value (Y) converted through the sRGB-to-YCbCr transformation matrix does not have a value of luminous intensity, that is, nit (cd/m$^2$) representing a real luminance, but only a value of brightness, that is, luma. Although the value of luma is regarded as the value of nit, the value of luma is not the same as the value of nit. Therefore, each of the light-emitting unit blocks controlled by the representative luminance value (Y) may not accurately generate dimmed light.

Referring to the above formula, because a transformation constant of the blue RGV (B) is 0.0722, the transformation constant of the blue RGV (B) has a value relatively lower than transformation constants of the red RGV (R) and the green RGV (G). That is, the gamma characteristics of the blue RGV (B) may be distorted due to a low resolution of the blue RGV (B).

Therefore, the local dimming method has limits as to how much the contrast ratio may be decreased due to a difference between the luma unit and the nit unit, and the low resolution of the blue RGV (B).

Exemplary embodiments of the present invention provide a method of local dimming capable of markedly increasing the contrast ratio.

Exemplary embodiments of the present invention also provide a backlight assembly suitable for performing the method.

Exemplary embodiments of the present invention also provide a display apparatus having the backlight assembly.

In an exemplary embodiment of the present invention, in order to perform local dimming, a driving dimming duty cycle is generated using a target gamma curve (TGV), the driving dimming duty cycle corresponds to an RGV of each of a plurality of dimming unit areas. Each of the light unit blocks of a light source is driven based on the driving dimming duty cycle, with the light unit blocks corresponding to the dimming unit areas, respectively.

In order to generate the driving dimming duty cycle, the RGV of each of the dimming unit areas may be generated based on image data. A target luminance value (TLV) corresponding to the RGV may be generated using the TGV. A light luminance value of each of the light unit blocks may be generated using the TLV. The driving dimming duty cycle corresponding to the light luminance value may be generated.

In order to generate the light luminance value, the light luminance value may be calculated from the TLV while considering interaction between the light-emitting unit blocks. For example, the light luminance value may be calculated from the TLV using a point spread function corresponding to the interaction between the light-emitting unit blocks.

The driving dimming duty cycle may have a duty value that is decreased by a difference between a real observed luminance value of a maximum driving duty corresponding to a maximum luminance and the TLV.

In order to generate the RGV, the RGV may be calculated from a plurality of individual grayscale values (IGVs) corresponding to unit pixels in each of the dimming unit areas, respectively. The RGV may be at least one of a number of values consisting of an average value of the IGVs, a maximum value of the IGVs, a minimum value of the IGVs, and a root mean square of the IGVs.

In order to calculate the RGV, a red RGV may be calculated from red IGVs for displaying a red image, a green RGV may be calculated from green IGVs for displaying a green image, and a blue RGV may calculated from blue IGVs for displaying a blue image.

In order to generate the TLV, a red TLV corresponding to the red RGV may be generated using a red TGV, a green TLV corresponding to the green RGV may be generated using a green TGV, and a blue TLV corresponding to the blue RGV may be generated using a blue TGV.

In order to drive each of the light unit blocks, each of a number of red unit light sources may be driven for generating red light using the red TLV, each of a number of green unit light sources may be driven for generating green light using the green TLV, and each of a number of blue unit light sources may be driven for generating blue light using the blue TLV. Alternatively, each of a number of white unit light sources may be driven for generating white light using the red TLV, the green TLV and the blue TLV.

In an exemplary embodiment of the present invention, a backlight assembly includes a light source, a local dimming control part, and a light-driving part.

The light source includes a plurality of light-emitting unit blocks corresponding to a plurality of dimming unit areas, respectively. The local dimming control part generates a driving dimming duty cycle corresponding to an RGV of each of the dimming unit areas using a TGV. The light-driving part drives each of the light-emitting unit blocks by a local dimming method in response to the driving dimming duty cycle.

The local dimming control part may include a representative value output part, a target value output part, a light luminance output part, and a dimming duty cycle output part.

The representative value output part generates the RGV of each of the dimming unit areas based on image data. The target value output part generates a TLV corresponding to the RGV using the TGV. The light luminance output part generates a light luminance value of each of the light unit blocks using the TLV. The dimming duty cycle output part generates the driving dimming duty cycle corresponding to the light luminance value.

The local dimming control part may further include a lookup memory storing a lookup table having information about the TGV. Alternatively, the target value output part may include a lookup memory storing a lookup table having information about the TGV.

The light-emitting unit blocks may include red light-emitting diodes (LEDs) generating red light, green LEDs generating green light, and blue LEDs generating blue light. Alternatively, the light-emitting unit blocks may include white LEDs generating white light.

In an exemplary embodiment of the present invention, a display apparatus includes a display panel and a backlight assembly. The display panel displays an image in response to image data applied from outside. The backlight assembly supplies light to the display panel.

The backlight assembly includes a light source, a local dimming control part, and a light-driving part. The light source includes light-emitting unit blocks corresponding to a plurality of dimming unit areas, respectively The local dimming control part generates a driving dimming duty cycle corresponding to an RGV of each of the dimming unit areas using a TGV. The light-driving part drives each of the light-emitting unit blocks by a local dimming method in response to the driving dimming duty.

The local dimming control part may include a representative value output part, a target value output part, a light luminance output part, and a dimming duty cycle output part. The representative value output part generates the RGV of each of the dimming unit areas based on image data. The target value output part generates a TLV corresponding to the RGV using the TGV. The light luminance output part generates a light luminance value of each of the light unit blocks using the TLV. The dimming duty cycle output part generates the driving dimming duty cycle corresponding to the light luminance value.

The display apparatus may further include a timing control part controlling the display panel and the local dimming control part in response to the image data.

According to the above-mentioned exemplary embodiments of the present invention, because a TLV is generated from an RGV of each of a number of dimming unit areas using a TGV so that a light-emitting unit block corresponding to each of the dimming unit areas is driven based on the TLV, a display apparatus may display an image having a higher contrast ratio.

BRIEF DESCRIPTION OF THE DRAWINGS

Exemplary embodiments of the present invention will be understood in more detail from the following descriptions taken in conjunction with the accompanying drawings, wherein.

DETAILED DESCRIPTION OF EXEMPLARY EMBODIMENTS

Figure 1:
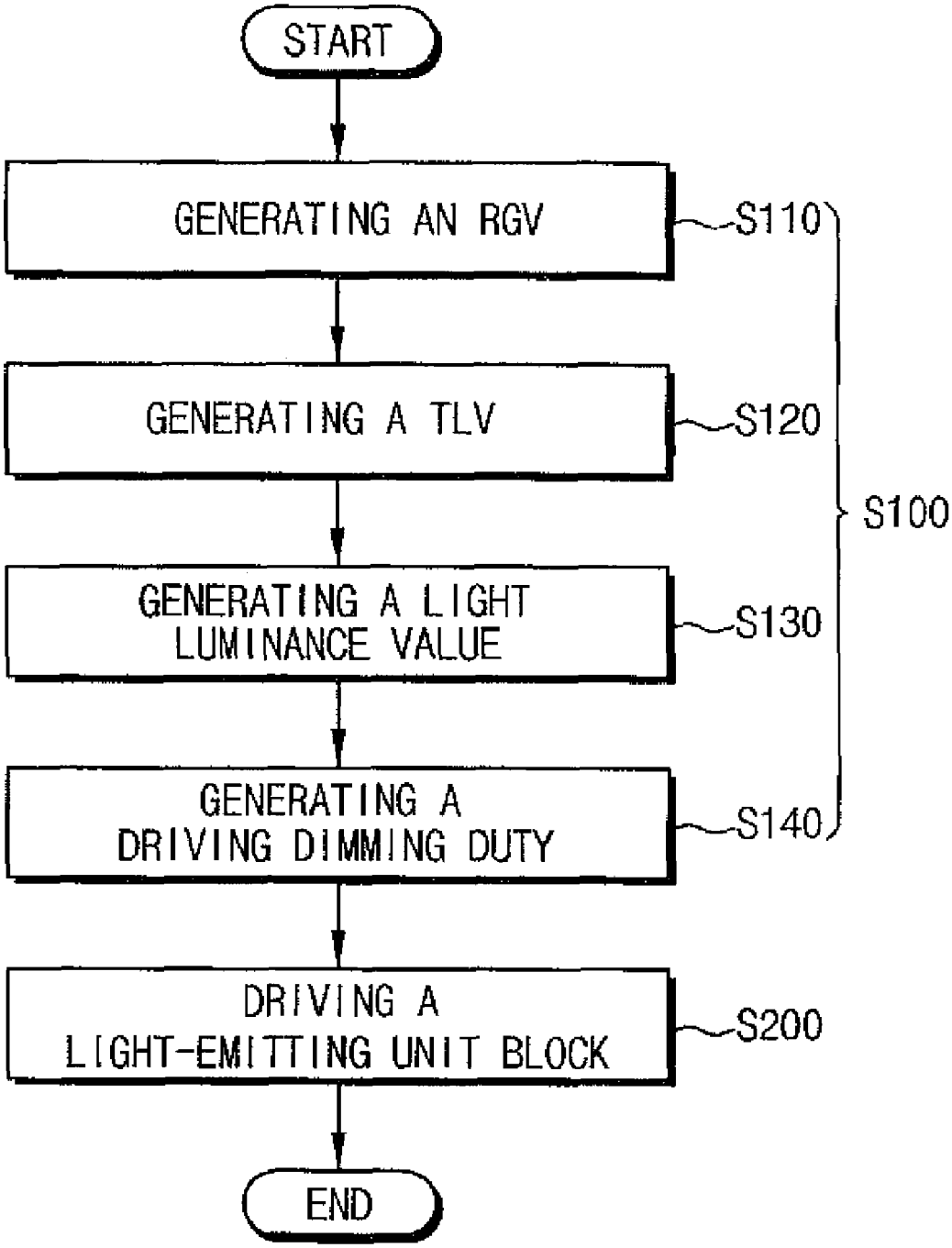
FIG. 1 is a flowchart illustrating a method of local dimming according to an exemplary embodiment of the present invention.

Exemplary embodiments of the present invention are described more fully hereinafter with reference to the accompanying drawings, in which exemplary embodiments of the present invention are shown. This invention may, however, be embodied in many different forms and should not be construed as limited to the exemplary embodiments set forth herein. Rather, these exemplary embodiments are provided so that this disclosure will be thorough and complete, and will fully convey the scope of the invention to those of ordinary skill in the art. In the drawings, the size and relative sizes of layers and regions may be exaggerated for clarity.

Hereinafter, exemplary embodiments of the present invention will be described in detail with reference to the accompanying drawings.

FIG. 1 is a flowchart illustrating a method of local dimming according to an exemplary embodiment of the present invention.

Referring to FIG. 1, a method of local dimming according to an exemplary embodiment of the present embodiment includes two steps on a large scale.

In a first large-scale step, a driving dimming duty cycle is generated using a target gamma curve value (TGV) (step S100). The driving dimming duty cycle corresponds to a representative grayscale value (RGV) of each of a plurality of dimming unit areas.

In a second large-scale step, each of a plurality of light-emitting unit blocks included in a light source is driven based on the driving dimming duty cycle (step S200). The light-emitting unit blocks correspond to the dimming unit areas, respectively.

In the present exemplary embodiment, the first step of generating the driving dimming duty cycle may include four steps.

Initially, the RGV of each of the dimming unit areas may be generated based on the image data (step S110). The dimming unit areas are unit areas that are individually controlled to generate light.

A plurality of unit pixels for displaying an image is formed in each of the dimming unit areas. The unit pixels may be controlled by gray data included in the image data to display an image. The gray data includes a plurality of individual grayscale values (IGVs) for controlling the unit pixels, respectively. For example, each of the IGVs may have a value in a range from 0 to 255, that is, the values can be determined by 8 bits.

The RGV of each of the dimming unit areas is a value calculated from the IGVs of each of the dimming unit areas. For example, the RGV may be at least one of a number of values consisting of an average value of the IGVs, a maximum value of the IGVs, a minimum value of the IGVs, and a root mean square of the IGVs.

The unit pixels may include red unit pixels displaying a red image, green unit pixels displaying green image, and blue unit pixels displaying blue image. Thus, the IGVs may include red IGVs corresponding to the red unit pixels, green IGVs corresponding to the green unit pixels, and blue IGVs corresponding to the blue unit pixels. The RGV may include a red RGV corresponding to the red IGVs, a green RGV corresponding to the green IGVs, and a blue RGV corresponding to the blue IGVs.

That is, the red RGV may be calculated from the red IGVs that control the red unit pixels, respectively. The green RGV may be calculated from the green IGVs that control the green unit pixels, respectively. The blue RGV may be calculated from the blue IGVs that control the blue unit pixels, respectively.

Second, a target luminance value (TLV) corresponding to the RGV may be generated using the TGV after the RGV is generated (step S120). The TGV is data including a relationship between grayscale values and ideal luminance values corresponding to the grayscale values.

The TGV may include a red TGV having luminance characteristics of red grayscale values, a green TGV having luminance characteristics of green grayscale values, and a blue TGV having luminance characteristics of blue grayscale values. Thus, the TLV may include a red TLV having ideal red luminance values, a green TLV having ideal green luminance values, and a blue TLV having ideal blue luminance values.

That is, the red TLV may be calculated from the red RGV using the red TGV, the green TLV may be calculated from the green RGV using the green TGV, and the blue TLV may be calculated from the blue RGV using the blue TGV.

Third, a light luminance value of each of the light unit blocks may be generated using the TLV (step 130).

When one of the light unit blocks corresponds to one of the dimming unit areas, the light luminance value is a luminance value of the one of the dimming unit areas that is formed by light generated from the one of the light unit blocks.

Fourth, the driving dimming duty cycle corresponding to the light luminance value may be generated after the light luminance value is generated (step S140).

The driving dimming duty cycle is a dimming duty cycle controlling the one of the light unit blocks to generate light that has the light luminance value in the one of the dimming unit areas.

Each of the light-emitting unit blocks may include at least one red unit light source, at least one green unit light source, and at least one blue unit light source. Thus, the light luminance value may include a red light luminance value of the red unit light source, a green light luminance value of the green unit light source, and a blue light luminance value of the blue unit light source. The driving dimming duty cycle may include a red driving dimming duty cycle corresponding to the red light luminance value, a green driving dimming duty cycle corresponding to the green light luminance value, and a blue driving dimming duty cycle corresponding to the blue light luminance value.

That is, the red light luminance value may be calculated from the red TLV, the red driving dimming duty cycle may be calculated from the red light luminance value, and the red unit light source may be driven by the red driving dimming duty cycle. The green light luminance value may be calculated from the green TLV, the green driving dimming duty cycle may be calculated from the green light luminance value, and the green unit light source may be driven by the green driving dimming duty cycle. The blue light luminance value may be calculated from the blue TLV, the blue driving dimming duty cycle may be calculated from the blue light luminance value, and the blue unit light source may be driven by the blue driving dimming duty cycle.

Alternatively, each of the light-emitting unit blocks may include at least one white unit light source generating white light. That is, the white light luminance value may be calculated from the red TLV, the green TLV and the blue TLV. The white driving dimming duty cycle may be calculated from the white light luminance value, and the white unit light source may be driven by the white driving dimming duty cycle.

In the present exemplary embodiment, the light luminance value may be calculated from the TLV while considering interaction between the light-emitting unit blocks. For example, the light luminance value may be calculated from the TLV using a point spread function corresponding to the interaction between the light-emitting unit blocks.

That is, the red light luminance value may be calculated from the red TLV using the point spread function, the green light luminance value may be calculated from the green TLV using the point spread function, and the blue light luminance value may be calculated from the blue TLV using the point spread function. Also, the white light luminance value may be calculated from the red TLV, green TLV and the blue TLV using the point spread function.

In the present exemplary embodiment, the driving dimming duty cycle may have a duty cycle value that is decreased by a difference duty cycle from a maximum driving duty cycle corresponding to a maximum luminance. The difference duty cycle corresponds to a difference between a real observed luminance value and the TLV.

That is, the red driving dimming duty cycle may have a duty cycle value that is decreased from a maximum red driving duty cycle corresponding to a maximum red luminance by a difference duty cycle between a real observation red luminance value and the red TLV. The green driving dimming duty cycle may have a duty cycle value that is decreased from a maximum green driving duty cycle corresponding to a maximum green luminance by a difference duty cycle between a real observation green luminance value and the green TLV. The blue driving dimming duty cycle may have a duty cycle value that is decreased from a maximum blue driving duty cycle corresponding to a maximum blue luminance by a difference duty cycle between a real observation blue luminance value and the blue TLV. Also, the white driving dimming duty cycle may have a duty cycle value that is decreased from a maximum white driving duty cycle corresponding to a maximum white luminance by a difference duty cycle between a real observation white luminance value and the white TLV.

Figure 2:
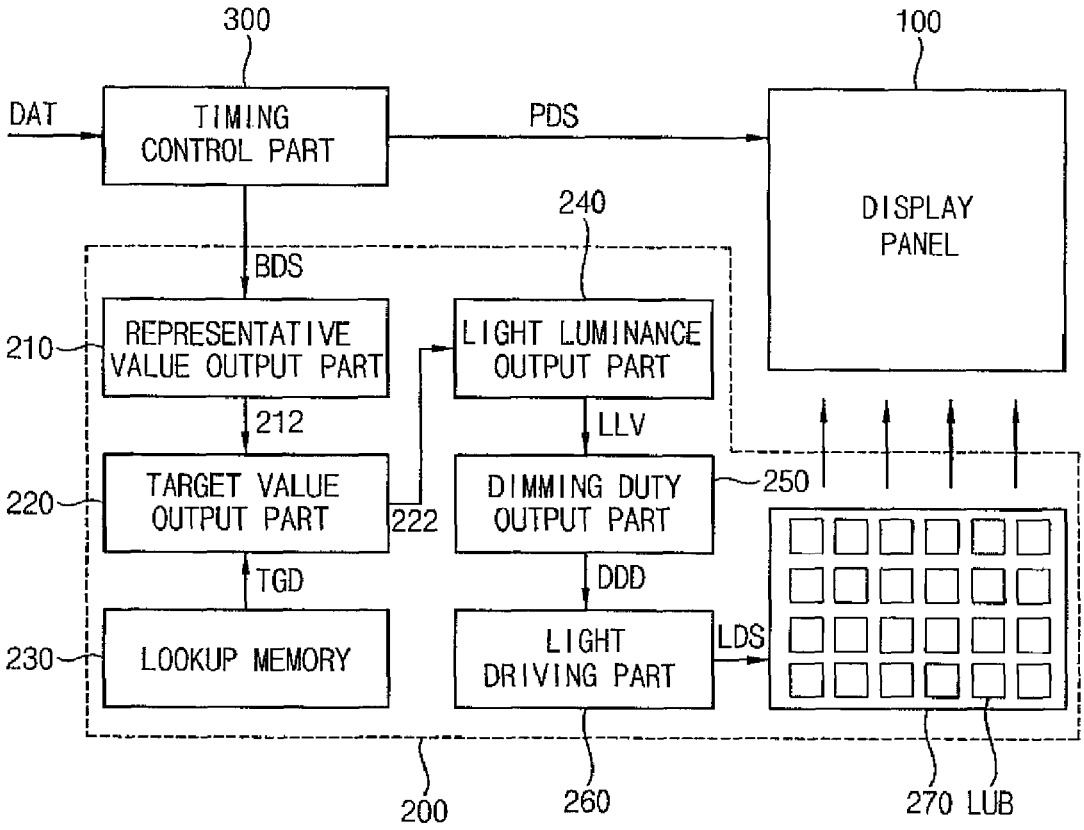
FIG. 2 is a block diagram illustrating a display apparatus for performing the local dimming method of FIG. 1.
Figure 3:
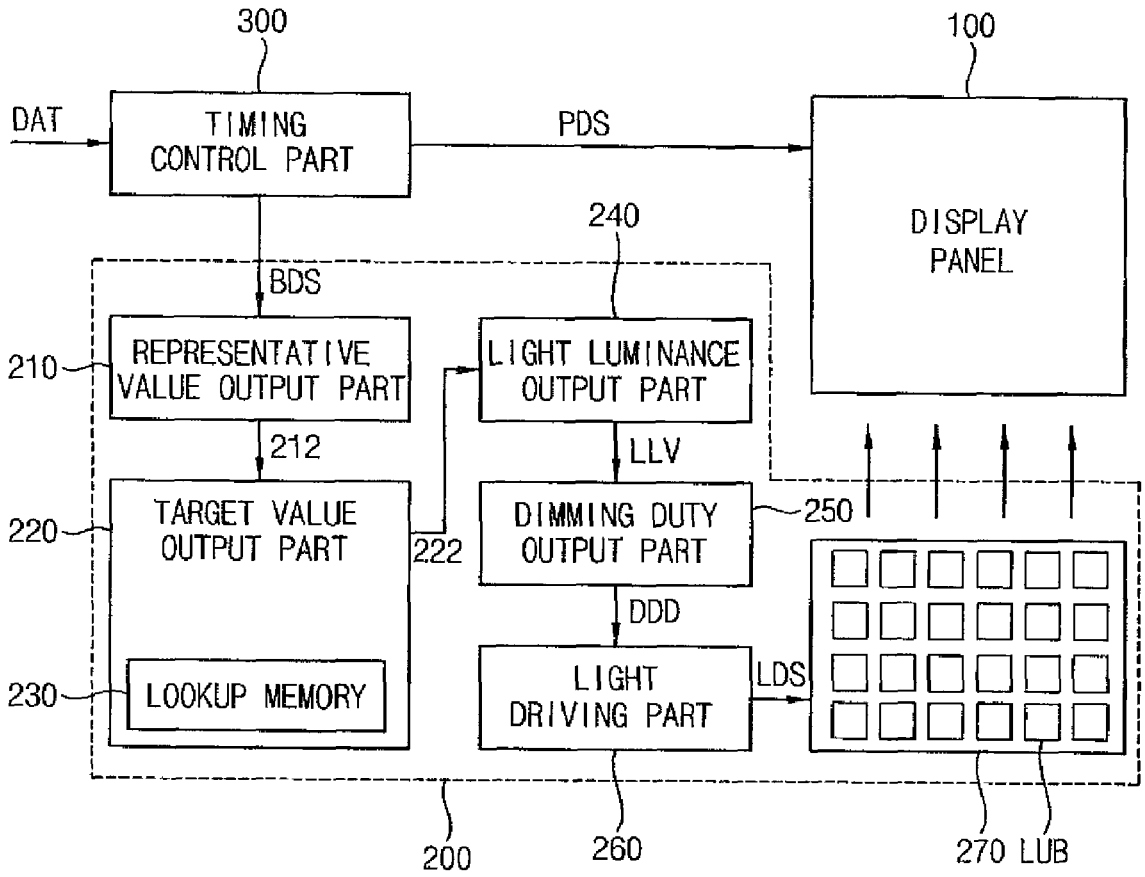
FIG. 3 is a block diagram illustrating a display apparatus having a lookup memory included in a target value output part of FIG. 2.

FIG. 2 is a block diagram illustrating a display apparatus according to an exemplary embodiment of the present invention for performing the local dimming method of FIG. 1. FIG. 3 is a block diagram illustrating a display apparatus according to an exemplary embodiment of the present invention having a lookup memory included in a target value output part in the apparatus of FIG. 2.

Referring to FIGS. 1 and 2, a display apparatus according to an exemplary embodiment may include a display panel 100 displaying an image, a backlight assembly 200 supplying light to the display panel 100, and a timing control part 300 controlling the display panel 100 and the backlight assembly 200.

The display panel 100, although not shown, may include a first substrate, a second substrate facing the first substrate, and a liquid crystal layer interposed between the first substrate and second substrate.

The first substrate includes a plurality of pixel electrodes disposed according to a matrix form, a plurality of thin-film transistors (TFTS) electrically connected to the pixel electrodes, and signal lines electrically connected to the TFTs.

The second substrate includes a common electrode formed on the entire face of a substrate and a plurality of color filters corresponding to the pixel electrodes, respectively. The color filters may include red color filters, green color filters, and blue color filters. The color filters may be included in the first substrate, not the second substrate.

The arrangement of the liquid crystal layer is changed by an electric field formed between the pixel electrodes and the common electrode, so that the light transmissivity of the liquid crystal layer is changed.

A display area of the display panel 100 may include a plurality of unit pixels corresponding to the color filters. The unit pixels may include red unit pixels corresponding to the red color filters, green unit pixels corresponding to the green color filters, and blue unit pixels corresponding to the blue color filters.

The backlight assembly 200 is disposed under the display panel 100 to supply light to the display panel. The display panel 100 may display an image using the light generated from the backlight assembly 200.

The timing control part 300 may receive image data DAT from an external system (not shown) to control the display panel 100 and the backlight assembly 200 in response to the image data DAT.

The image data DAT includes IGVs corresponding to pixel voltages applied to the pixel electrodes. The IGVs include red IGVs corresponding to the red unit pixels, green IGVs corresponding to the green unit pixels, and blue IGVs corresponding to the blue unit pixels.

The timing control part 300 may generate a panel driving signal PDS fed to the display panel 100 to control the display panel. The timing control part may generate a backlight driving signal BDS fed to the backlight assembly 200 to control the backlight assembly 200.

The backlight assembly 200 includes a local dimming control part, described below, for performing step S100 of FIG. 1, a light-driving part 260 for performing step S200 of FIG. 1, and a light source 270 controlled by the light-driving part 260 to generate light. The light source 270 includes a plurality of light-emitting unit blocks LUB corresponding to the dimming unit areas, respectively.

The local dimming control part may include a representative value output part 210 for performing step S110 of FIG. 1, a target value output part 220 for performing step S120 of FIG. 1, a lookup memory 230, a light luminance output part 240 for performing step S130 of FIG. 1, and a dimming duty cycle output part 250 for performing step S140 of FIG. 1.

The representative value output part 210 receives the backlight driving signal BDS from the timing control part 300. Alternatively, the representative value output part 210 may directly receive the backlight driving signal BDS from the external system supplying the image data.

The representative value output part 210 calculates the RGVs 212 from the IGVs of the backlight driving signal BDS corresponding to the dimming unit areas, and generates the RGVs 212 to the target value output part 220. That is, the representative value output part 210 performs step S110 of FIG. 1 to supply the RGVs 212 to the target value output part 220. The RGVs 212 may be at least one of an average value, a maximum value, a minimum value, and a root mean square of the IGVs corresponding to each of the dimming unit areas.

The target value output part 220 receives the RGVs 212 from the representative value output part 210 and calculates TLVs 222 from the RGVs 212 to output the TLVs 222 to the light luminance output part 240.

The lookup memory 230 stores a lookup table having information about the TGV. The TGV may be changed according to characteristics of the display panel 100 or customer demand. The lookup memory 230 supplies target gamma data TGD from the lookup table to the target value output part 220.

The target value output part 220 receives the target gamma data TGD from the lookup memory 230, and generates the TLVs 222 corresponding to the RGVs 212 using the information of the TGV included in the TGD. That is, the target value output part 220 performs step S120 of FIG. 1 to supply the TLVs 222 to the light luminance output part 240.

Referring to FIG. 3, alternatively the lookup memory 230 may be included in the target value output part 220, unlike what is shown in FIG. 2. That is, the lookup memory 230 may be an internal memory included in the target value output part 220.

The light luminance output part 240 receives the TLVs 222 from the target value output part 220 and calculates light luminance values LLV from the TLVs 222 to output the light luminance values LLV to the dimming duty cycle output part 250. That is, the light luminance output part 240 performs step S130 of FIG. 1 to supply the light luminance values LLV to the dimming duty cycle output part 250.

For example, the light luminance output part 240 may calculate the light luminance values LLV from the TLVs 222 using the point spread function.

The dimming duty cycle output part 250 receives the light luminance values LLV from the light luminance output part 240 and generates the driving dimming duty cycle DDD corresponding to the light luminance values LLV, respectively, to output the driving dimming duty cycle DDD to the light-driving part 260. That is, the dimming duty cycle output part 250 performs step S140 of FIG. 1 to supply the driving dimming duty cycle DDD to the light-driving part 260.

The light-driving part 260 receives the driving dimming duty cycle DDD from the dimming duty output part 250 and outputs light-driving signals LDS to the respective light-emitting unit blocks LUB of the light source 270 in response to the driving dimming duty cycle DDD. That is, the light-driving part 260 performs step S200 of FIG. 1 to individually drive the light-emitting unit blocks LUB through the light-driving signals LDS.

The light-emitting unit blocks LUB receive the light-driving signals LDS from the light-driving part 260 and are driven in response to the driving dimming duty cycle DDD to generate light.

Figure 4:
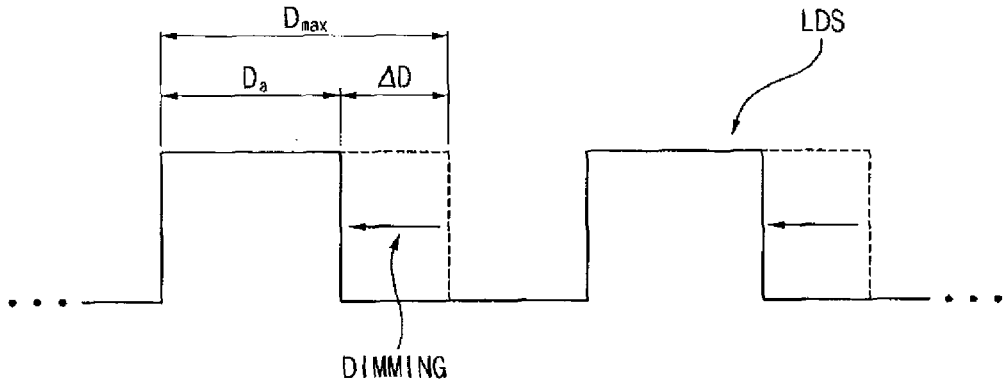
FIG. 4 is a waveform diagram illustrating one of the light-dimming signals in the apparatus of FIG. 2.

FIG. 4 is a waveform diagram illustrating one of light-dimming signals LDS of FIG. 2.

Referring to FIGS. 2 and 4, the light-driving signal LDS according to an exemplary embodiment is a pulse width modulation (PWM) signal that has the driving dimming duty cycle Da dimmed or shortened by a predetermined duty cycle width ΔD from the maximum driving duty cycle Dmax.

The maximum driving duty cycle Dmax has a pulse width corresponding to a maximum luminance of an image displayed on the display panel 100. For example, the maximum driving duty cycle Dmax may have a pulse width corresponding to a luminance suited for displaying a white image on the display panel 100.

The driving dimming duty cycle Da has a pulse width that is decreased by the predetermined duty cycle width ΔD from the maximum driving duty cycle Dmax. The predetermined duty cycle width ΔD may have a value corresponding to a difference between a real observed luminance value of the display panel 100 and the TLV.

Figure 5:
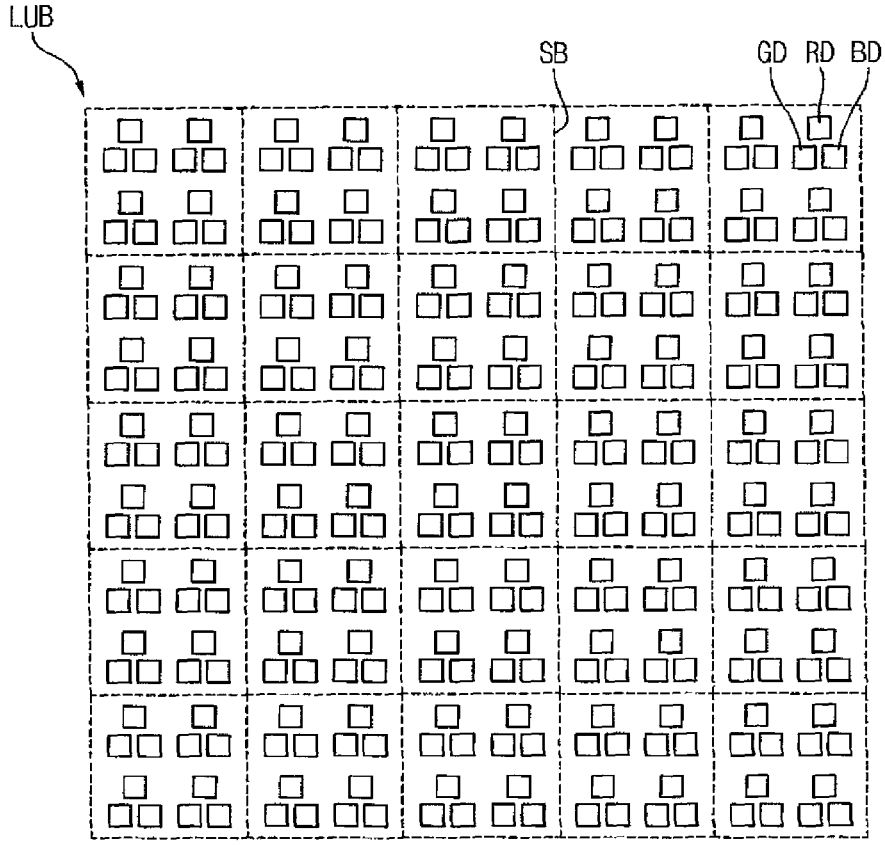
FIGS. 5 and 6 are plan views illustrating one of the light-emitting unit blocks in the apparatus of FIG. 2.
Figure 6:
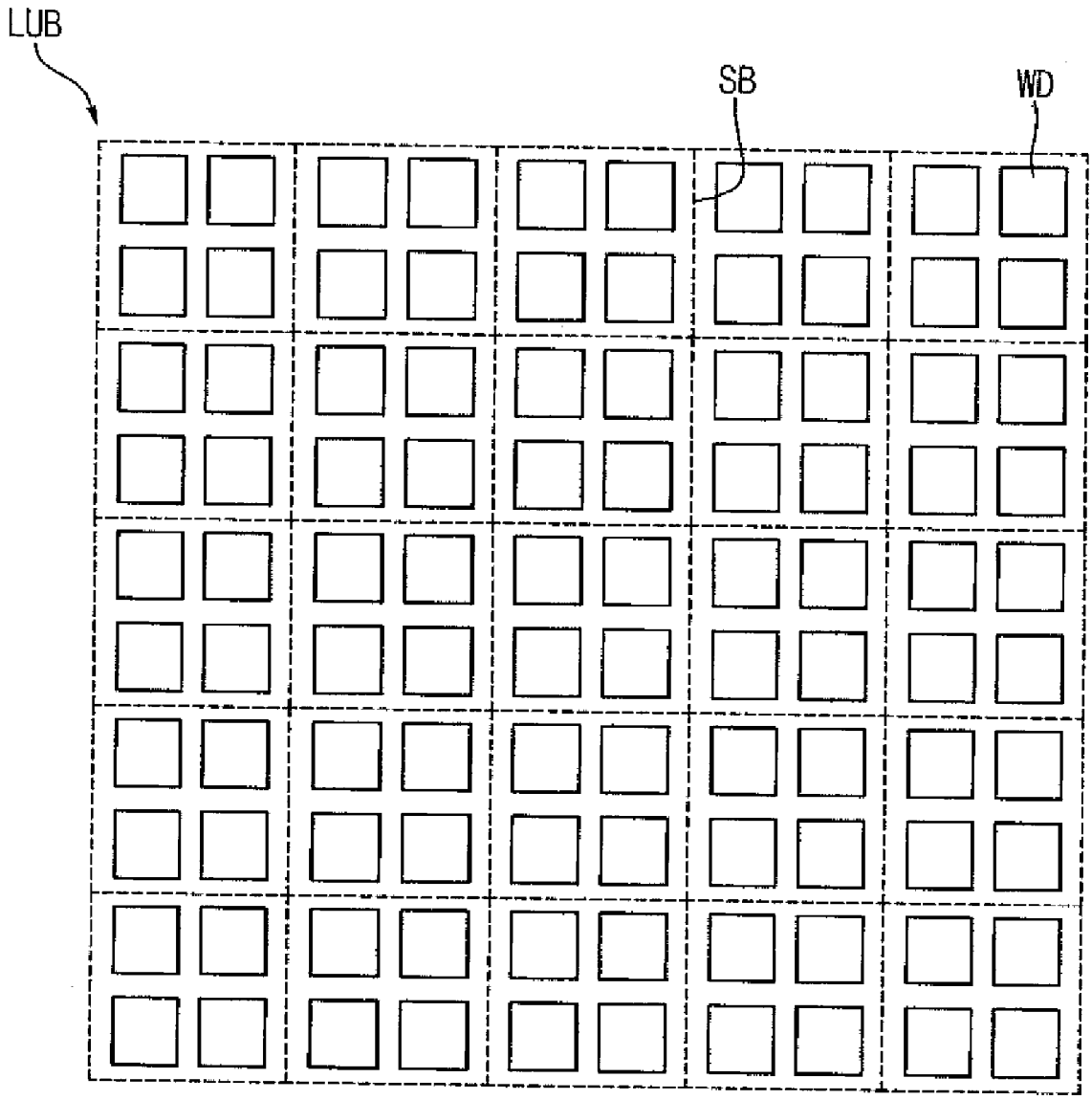

FIGS. 5 and 6 are plan views illustrating one of the light-emitting unit blocks LUB of the apparatus of FIG. 2;

Referring to FIGS. 2 and 5, each of the light-emitting unit blocks LUB according to an exemplary embodiment may include a plurality of sub-blocks SB shown in dashed lines respectively corresponding to the pixel electrodes of the display panel 100, respectively. For example, each of the light-emitting unit blocks LUB may include the sub-blocks SB disposed in a 5×5 matrix as shown in FIG. 5.

Each of the sub-blocks SB may include red LEDs RD generating red light, green LEDs GD generating green light, and blue LEDs BD generating blue light. For example, each of the sub-blocks SB may include four of the red LEDs RD, four of the green LEDs GD, and four of the blue LEDs BD.

The red LEDs RD of each of the sub-blocks SB are driven all at once by the red driving dimming duty cycle, as shown in FIG. 4, for example, to generate red light. The green LEDs GD of each of the sub-blocks SB are driven all at once by the green driving dimming duty cycle to generate green light. The blue LEDs BD of each of the sub-blocks SB are driven all at once by the blue driving dimming duty cycle to generate blue light. The red, green and blue lights are mixed to form white light.

Referring to FIG. 6, each of the light-emitting unit blocks LUB may include the sub-blocks SB shown in dashed lines, and each of the sub-blocks SB may include a number of white LEDs WD generating white light, unlike what is shown in FIG. 5. For example, each of the sub-blocks SB may include Sour of the white LEDs WD. The white LEDs WD of each of the sub-blocks SB are driven all at once by the white driving dimming duty cycle signal, as shown in FIG. 4, for example, to generate white light.

Figure 7:
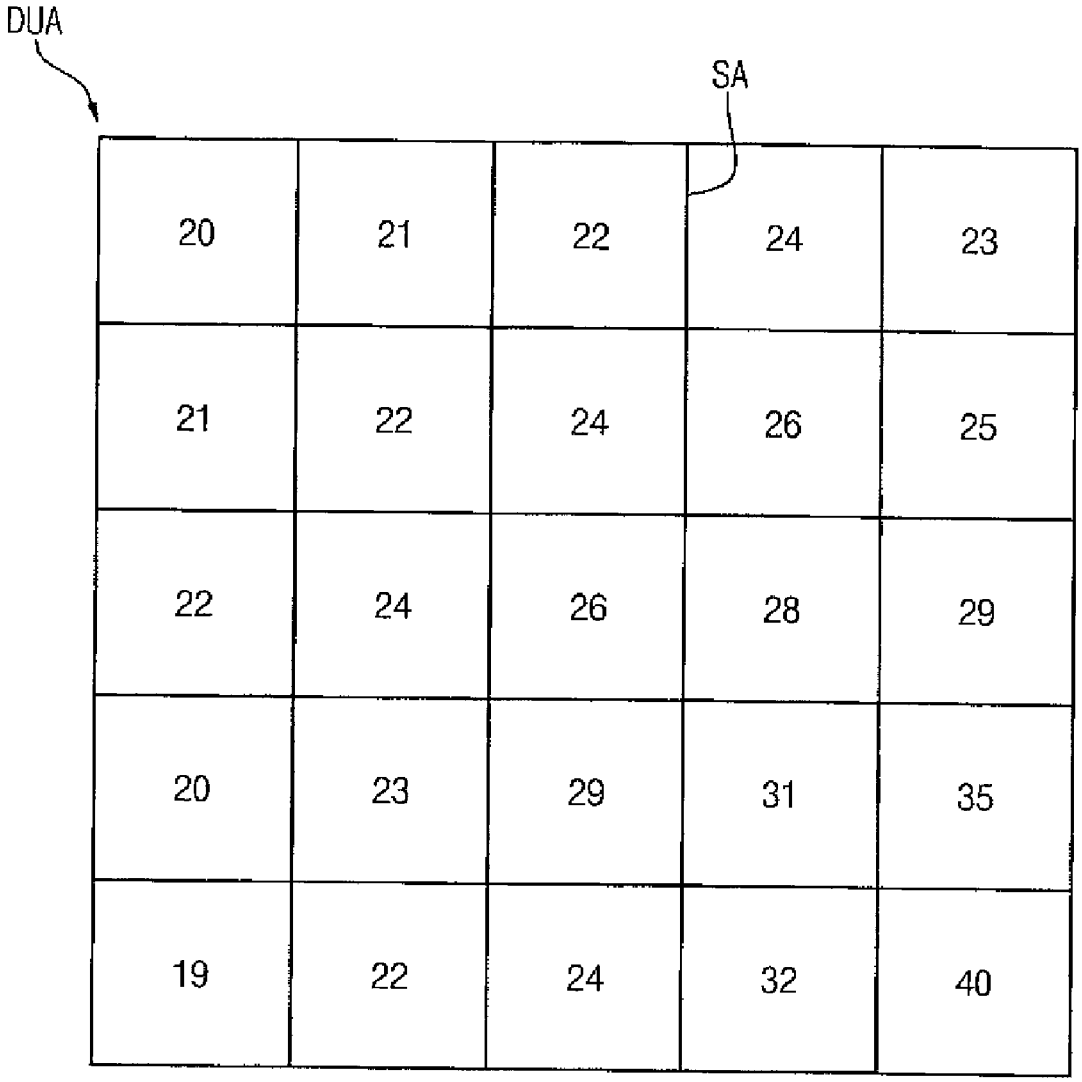
FIG. 7 is a plan view illustrating a process of calculating a representative grayscale value (RGV) representing each of the dimming unit areas in an exemplary embodiment of the present invention.

FIG. 7 is a plan view illustrating a process of calculating an RGV representing each of the plurality of dimming unit areas in an exemplary embodiment of the present invention.

Referring to FIGS. 1, 2 and 7, each of the dimming unit areas DUA according to the present exemplary embodiment includes a plurality of sub-unit areas SA corresponding respectively to the pixel electrodes of the display panel 100. That is, the sub-unit areas SA correspond to the sub-blocks SB in FIGS. 5 and 6. For example, each of the dimming unit areas DUA may include the sub-unit areas SA disposed in a 5×5 matrix.

For example, 25 IGVs for controlling the pixel electrodes corresponding to the sub-unit areas SA are shown in FIG. 7. The RGV representing each of the dimming unit areas DUA may be calculated from the 25 IGVs. The number in the block is the IGV. That is, step S110 of FIG. 1 is performed so that the RGV is generated from the 25 IGVs.

For example, when the RGV is an average of the 25 IGVs, the RGV has about 25 gray levels. When the RGV is a maximum of the 25 IGVs, the RGV has about 40 gray levels. When the RGV is a minimum of the 25 IGVs, the RGV has about 19 gray levels.

Figure 8:
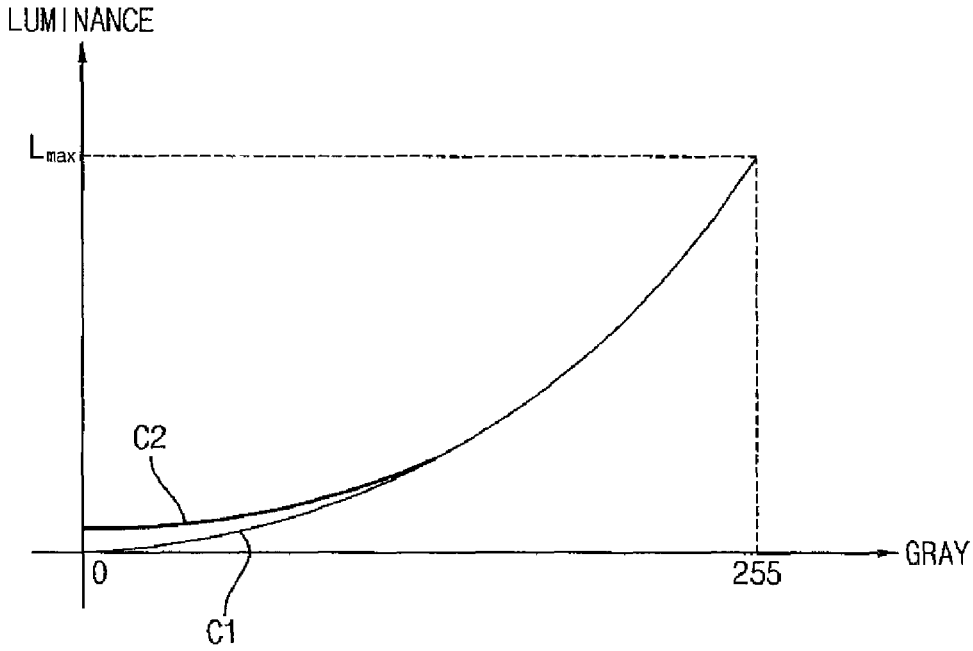
FIG. 8 is a graph illustrating a relationship between a real observation gamma curve and a target gamma curve (TGV) in a display panel in the apparatus of FIG. 2.

FIG. 8 is a graph illustrating a relationship between a real observation gamma curve and a TGV in a display panel 100 of the apparatus of FIG. 2.

Referring to FIGS. 2 and 8, the TGV C1 is a curve illustrating an ideal relationship between a grayscale value of the display panel 100 and a luminance value. The real observation gamma curve C2 is a curve illustrating a relationship between a grayscale value of the display panel 100 and a luminance value according to a result that is measured in the display panel 100. The X-axis represents the gray levels ranged from 0 to 255, and the Y-axis represents a luminance level. The graph of FIG. 8 illustrates data measured in a state in which a maximum luminance Lmax of light is supplied to the display panel 100.

When a relationship between the TGV C1 and the real observation gamma curve C2 is explained briefly, the TGV C1 and the real observation gamma curve C2 at a higher gray level are nearly the same as each other. Whereas, the real observation gamma curve C2 at a low grayscale level is above the TGV C1.

The real observation gamma curve C2 at the low grayscale level is higher than the TGV C1, and thus the display panel 100 generates a light leak at a low grayscale level.

Figure 9:
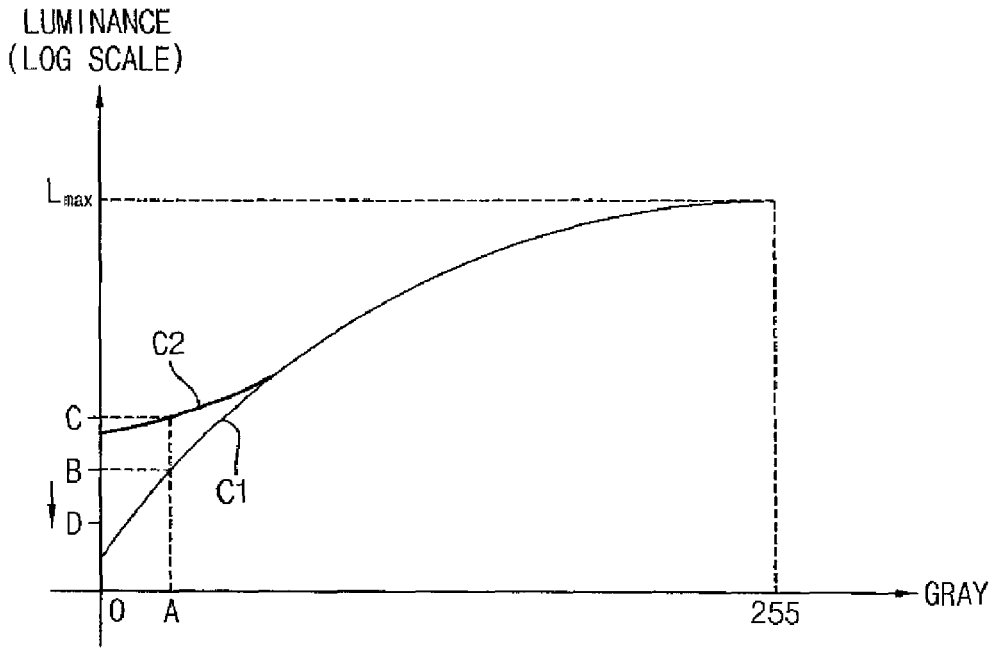
FIG. 9 is a graph illustrating a process of calculating a target grayscale value and a light luminance from the RGV in an exemplary embodiment of the present embodiment.

FIG. 9 is a graph illustrating a process of calculating a target grayseale value and a light luminance from the RGV in the present exemplary embodiment.

Referring to FIGS. 2, 7, and 9, the graph of FIG. 9 is the same as the graph of FIG. 8 except that the Y-axis is converted to a log scale.

When the RGV 212 of each of the dimming unit areas DUA is determined, the TLV 222 is generated using the TGV C1. The point B on the Y-axis corresponding to the TLV 222 is determined from the point A of the X-axis corresponding to the RGV 212 using the TGV C1. That is, step S120 of FIG. 1 is performed so that the TLV 222 is calculated from the RGV 212.

The display panel 100 displays an image having a luminance value of the point C in a state in which the maximum luminance Lmax is received. The point B illustrates an ideal luminance value of an image displayed on the display panel 100.

Therefore, because a real luminance value corresponding to the point A is above the calculated TLV 222, a luminance value of light applied to the display panel 100 needs to be decreased by a difference between the point C and the point B.

When the TLV 222 is determined to the point B, the light luminance value LLV of each of the light-emitting unit blocks LUB is calculated. That is, step S130 of FIG. 1 is performed so that the light luminance value LLV is calculated from the TLV 222.

Because the light luminance value LLV is determined while considering the interaction between the light-emitting unit blocks LUB, the light luminance value LLV is below the TLV 222. For example, the light luminance value LLV may be determined using the point spread function. That is, the light luminance value LLV may be determined to be the point ID of the Y-axis.

Therefore, when each of the light-emitting unit blocks LUB emits light at the light luminance value LLV, the luminance values measured at the dimming unit area DUA may be the TLVs 222, respectively.

Figure 10:
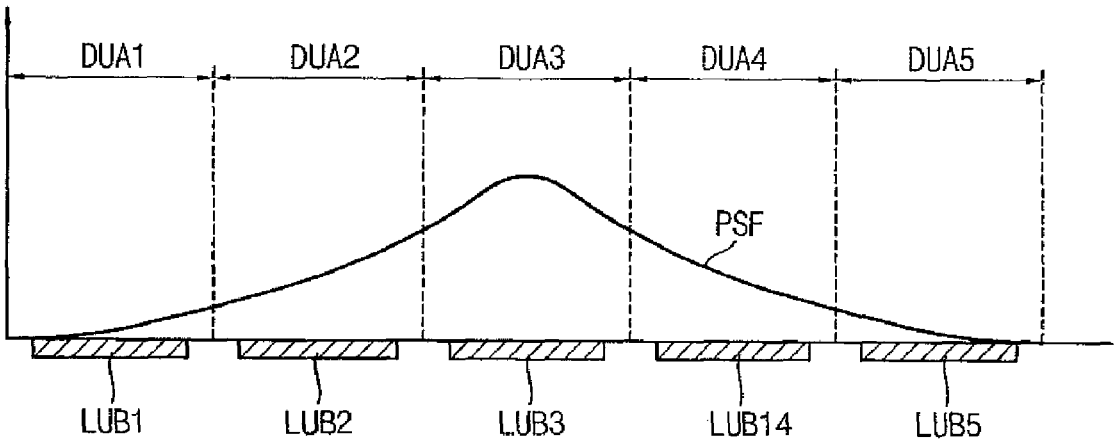
FIG. 10 is a representation illustrating a point spread function in an exemplary embodiment of the present invention.

FIG. 10 is a representation illustrating a point spread function in the present exemplary embodiment.

Referring to FIG. 10, a first DUA1, second DUA2, third DUA3, fourth DUA4, and fifth DUA5 dimming unit areas are disposed in order in the X-axis, for example. Also, a first LUB1, second LUB2, third LUB3, fourth LUB4, and fifth LUB5 light-emitting unit blocks are disposed corresponding respectively to the first, second, third, fourth and fifth dimming unit areas DUA 1-5.

When only the third light-emitting unit block LUB3 generates light, the light generated from the third light-emitting unit block LUB3 may be applied to not only the third dimming unit area DUA3, but also to the first, second, fourth and fifth dimming unit areas DUA 1-2 and DUA 4-5

Therefore, the light generated from the third light-emitting unit block LUB3 may be applied to all of the first, second, third, fourth and fifth dimming unit areas DUA 1-5 according the point spread function (PSF) that has a symmetric shape about the third dimming unit area DUA3, as shown in FIG. 10. The point spread function PSF may be a Gaussian function.

Because light generated from each of the light-emitting unit blocks LUB is supplied to a plurality of the dimming unit areas DUA, the light luminance value LLV needs to be determined while considering the interaction between the light-emitting unit blocks LUB. Thus, the LLV may become lower than the TLV.

According to the above-described exemplary embodiment, a representative luminance value is not calculated through a sRGB-to-YCbCr transformation matrix, but a TLV is calculated through a TGV. Thus, a display apparatus may display an image having a higher contrast ratio.

The image of the display apparatus may have a higher contrast ratio, and thus the TLV calculated from an RGV through the TGV is a luminance intensity value of nit (cd/m$^2$) representing a real luminance, and the TGV has higher resolution in relation to a red RGV, a green RGV and a blue RGV.

Although exemplary embodiments of the present invention have been described, it is understood that the present invention should not be limited to these exemplary embodiments but various changes and modifications can be made by one of ordinary skill in the art within the spirit and scope of the present invention, as hereinafter claimed.

What is claimed is:

1. A method of local dimming for a display panel, comprising:

generating a driving dimming duty cycle corresponding to a representative grayscale value (RGV) of each of a plurality of dimming unit areas using a target gamma curve (TGV); and driving each of a plurality of light unit blocks of a light source based on the driving dimming duty cycle, the plurality of light unit blocks corresponding to the plurality of dimming unit areas, respectively, wherein the driving dimming duty cycle is generated by:

generating the RGV of each of the plurality of dimming unit areas based on input image data;

generating a target luminance value (TLV) corresponding to the RGV using the TGV;

generating a light luminance value of each of the plurality of light unit blocks using the TLV; and generating the driving dimming duty cycle corresponding to the light luminance value.

2. The method of claim 1, wherein the light luminance value is generated by:

calculating the light luminance value from the TLV taking into consideration interaction between the light-emitting unit blocks.

3. The method of claim 2, wherein the light luminance value is calculated by:

calculating the light luminance value from the TLV using a point spread function corresponding to the interaction between the light-emitting unit blocks.

4. The method of claim 1, wherein the driving dimming duty cycle has a duty cycle value that is decreased by a difference between a real observed luminance value of a maximum driving duty corresponding to a maximum luminance and the TLV.

5. The method of claim 1, wherein the RGV is generated by:

calculating the RGV from a plurality of individual grayscale values (IGVs) corresponding to unit pixels in each of the plurality of dimming unit areas, respectively.

6. The method claim 5, wherein the RGV is at least one of values consisting of an average value of the IGVs, a maximum value of the IGVs, a minimum value of the IGVs, and a root mean square of the IGVs.

7. The method of claim 1, wherein the RGV is calculated by:

calculating a red RGV from red individual grayscale values (IGVs) for displaying a red image;

calculating a green RGV from green IGVs for displaying a green image; and calculating a blue RGV from blue IGVs for displaying a blue image.

8. The method of claim 7, wherein the TLV is generated by:

generating a red TLV corresponding to the red RGV using a red TGV;

generating a green TLV corresponding to the green RGV using a green TGV; and generating a blue TLV corresponding to the blue RGV using a blue TGV.

9. The method of claim 8, wherein each of the plurality of light unit blocks is driven by:

driving each of a plurality of red unit light sources for generating red light using the red TLV;

driving each of a plurality of green unit light sources for generating green light using the green TLV; and driving each of a plurality of blue unit light sources for generating blue light using the blue TLV.

10. The method of claim 8, wherein each of the plurality of light unit blocks is driven by:

driving each of a plurality of white unit light sources for generating white light using the red TLV, the green TLV and the blue TLV.

11. A backlight assembly comprising:

a light source including a plurality of light-emitting unit blocks corresponding to a plurality of dimming unit areas, respectively;

a local dimming control part generating a driving dimming duty cycle corresponding to a representative grayscale value (RGV) of each of the plurality of dimming unit areas using a target gamma curve value (TGV); and a light-driving part driving each of the plurality of light-emitting unit blocks by a local dimming method in response to the driving dimming duty cycle, wherein the local dimming control part comprises:

a representative value output part generating the RGV of each of the plurality of dimming unit areas based on image data;

a target value output part generating a target luminance value (TLV) corresponding to the RGV using the TGV;

a light luminance output part generating a light luminance value of each of the plurality of light unit blocks using the TLV; and a dimming duty cycle output part generating the driving dimming duty cycle corresponding to the light luminance value.

12. The backlight assembly of claim 11, wherein the local dimming control part further comprises:

a lookup memory storing a lookup table having information about the TGV.

13. The backlight assembly of claim 11, wherein the target value output part comprises:

a lookup memory storing a lookup table having information about the TGV.

14. The backlight assembly of claim 11, wherein the plurality of light-emitting unit blocks comprises:

red light-emitting diodes (LEDs) generating red light;

green LEDs generating green light; and blue LEDs generating blue light.

15. The backlight assembly of claim 11, wherein the light-emitting unit blocks comprises a plurality of white LEDs generating white light.

16. A display apparatus comprising:

a display panel displaying an image in response to image data applied from outside; and a backlight assembly supplying light to the display panel, the backlight assembly comprising:

a light source including a plurality of light-emitting unit blocks corresponding to a plurality of dimming unit areas, respectively;

a local dimming control part generating a driving dimming duty cycle corresponding to a representative grayscale value (RGV) of each of the dimming unit areas using a target gamma curve value (TGV); and a light-driving part driving each of the plurality of light-emitting unit blocks by a local dimming method in response to the driving dimming duty cycle, wherein the local dimming control part comprises:

a representative value output part generating the RGV of each of the plurality of dimming unit areas based on image data;

a target value output part generating a target luminance value (TLV) corresponding to the RGV using the TGV;

a light luminance output part generating a light luminance value of each of the plurality of light unit blocks using the TLV; and a dimming duty cycle output part generating the driving dimming duty cycle corresponding to the light luminance value.

17. The display apparatus of claim 16, further comprising:

a timing control part controlling the display panel and the local dimming control part in response to the image data.

* * * * *